US005184996A

United States Patent [19]

Rode et al.

[11] Patent Number: 5,184,996

[45] Date of Patent: Feb. 9, 1993

[54] CARTON ASSEMBLY MACHINE FOR ASSEMBLING A BASE AND A COVER

[75] Inventors: Chris Rode, Delphos; Steve Reigle, Pandora, both of Ohio

[73] Assignee: Gasdorf Tool & Machine Co., Inc., Lima, Ohio

[21] Appl. No.: 749,670

[22] Filed: Aug. 26, 1991

[51] Int. Cl.[5] ..... B31B 17/90; B31B 15/90

[52] U.S. Cl. ..... 493/84; 493/102; 493/116; 493/120; 53/136.4; 53/292; 53/580

[58] Field of Search ..... 53/136.4, 291, 292, 53/580; 493/84, 102, 116, 117, 120

[56] References Cited

U.S. PATENT DOCUMENTS

| | | | |
|---|---|---|---|
| 1,068,034 | 7/1913 | Auen | 493/102 |
| 1,700,893 | 2/1929 | Meyer-Jagenberg | 493/102 |
| 1,888,808 | 11/1932 | Schmiedel | 493/102 |
| 2,433,701 | 12/1947 | Linstedt | 53/291 |
| 3,138,905 | 6/1964 | Ellinger | 493/102 |
| 4,592,189 | 6/1986 | Martini | 53/136.4 |
| 4,809,482 | 3/1989 | Horton et al. | 53/131.3 |

*Primary Examiner*—William E. Terrell

*Attorney, Agent, or Firm*—Emch, Schaffer, Schaub & Porcello Co.

[57] ABSTRACT

A carton assembly machine for assembling a cover on a base is disclosed. The machine includes a frame and a first conveyor for transporting a plurality of bases. A second conveyor transports a plurality of folded covers. At an unfolding station, suction cups grasp the folded cover and are pivoted to open the cover. The cover is then moved to an assembly station where it is positioned over a carton base. A plurality of hand assemblies are moved vertically downwardly to grasp the cover and move it into overlying relationship with the base. The hand assemblies are then removed and the assembled carton moved to a tape station where tape heads apply a strip of tape to the assembled cover and base. After taping, the assembled carton is removed from the carton assembly machine.

21 Claims, 13 Drawing Sheets

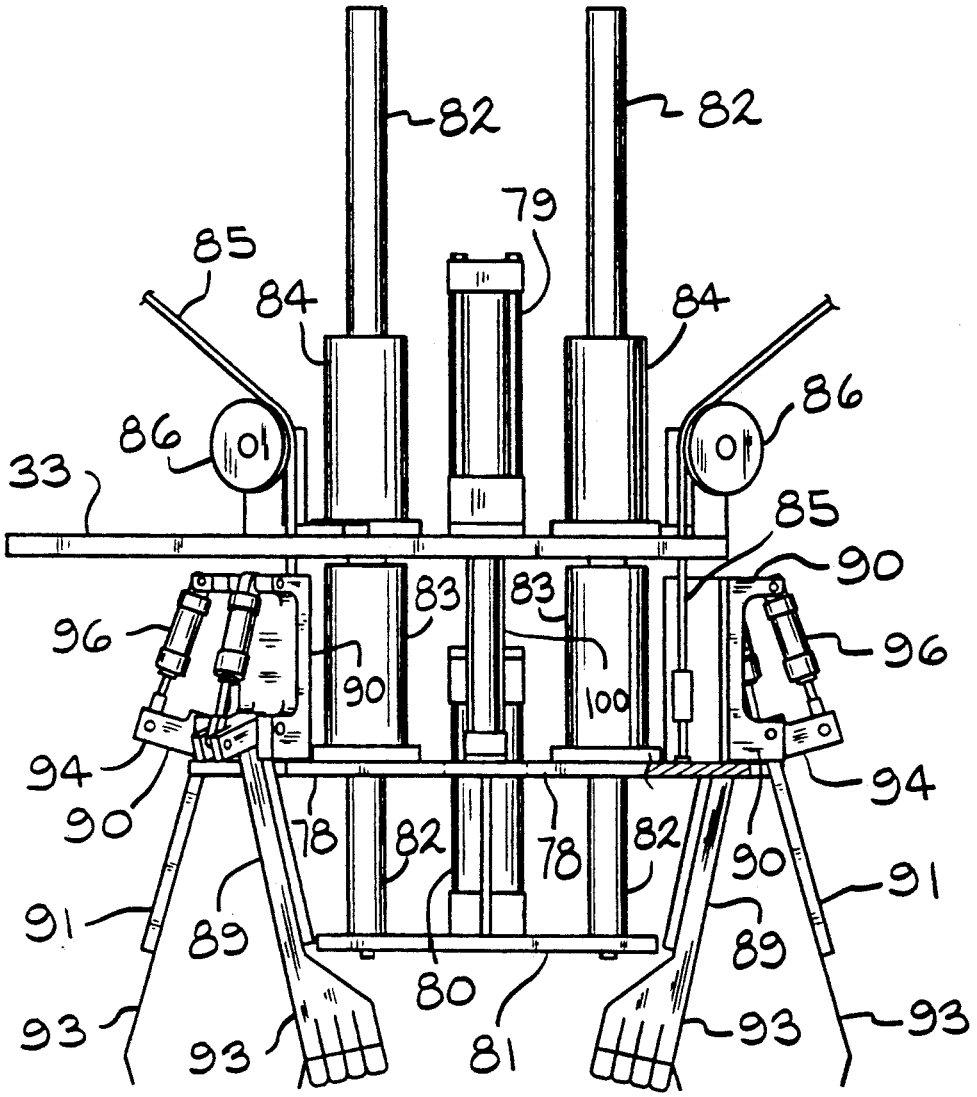
FIG. 9
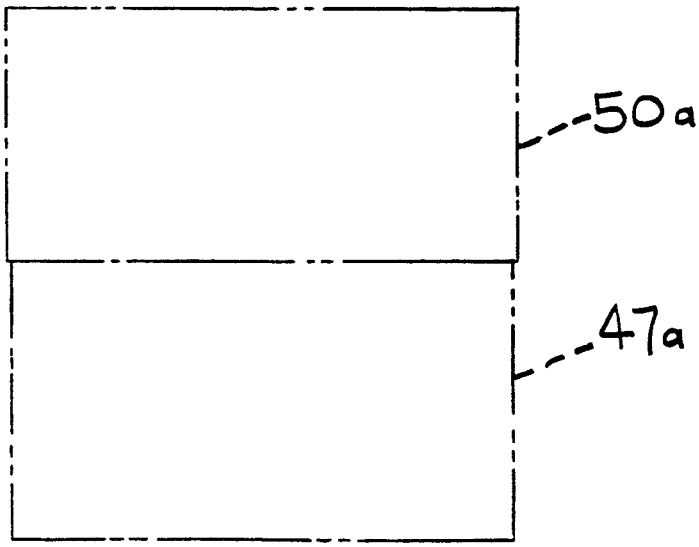

CARTON ASSEMBLY MACHINE FOR ASSEMBLING A BASE AND A COVER

BACKGROUND OF THE INVENTION

The present invention is directed to a carton assembly machine and more particularly to a carton assembly machine for a two-piece corrugated shipping carton. It is relatively common to ship the lid or cover in a flat or folded condition. Prior to further processing of a carton, the lid or cover must be unfolded and placed on the base of the carton.

In some point-of-sale type cartons, a rectangular carton base is open on the sides so that the consumer may see the product without removing the carton from the product.

Machines for assembling cartons have been known in the art.

SUMMARY OF THE INVENTION

The present invention relates to an improved assembly machine for a carton having a rectangular base and a cover. The machine includes a frame mounting a first conveyor for transporting a plurality of serially positioned rectangular bases. A second conveyor is provided for transporting a plurality of folded covers. At a machine station, a first cover means for opening a cover is provided. At a second station, the cover is grasped and moved downwardly into an overlying relationship with the rectangular base. At a taping station, tape is applied to connect the cover to the rectangular base. The assembled cover is then removed from the machine.

DESCRIPTION OF THE DRAWINGS

FIG. 9 is a fragmentary end view showing the apparatus of FIG. 8;

DESCRIPTION OF THE PREFERRED EMBODIMENTS

Figure 1:
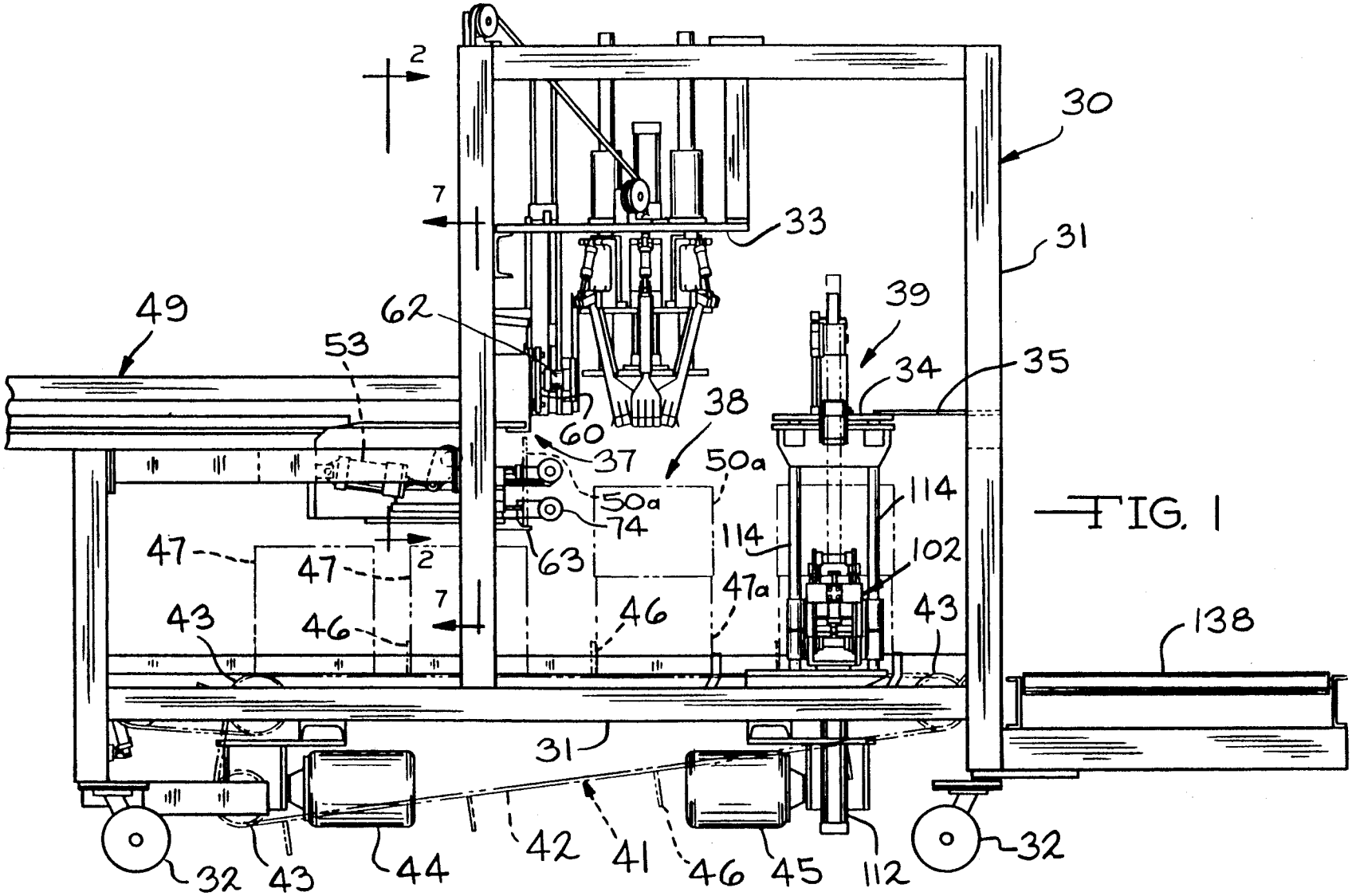
FIG. 1 is an elevational view of a carton assembly machine, according to the present invention.

A carton assembly machine, according to the present invention, is generally indicated in FIG. 1 by the reference number 30. The carton assembly machine 30 includes a frame 31 mounted on wheels 32. A generally horizontal platform 33 is mounted on the frame 31. A tape platform 34 is also connected to the frame 31 by a connecting member 35 and by guide rods 114. The carton assembly machine 30 includes an unfolding station 37, an assembly station 38 and a taping station 39.

A first conveyor means 41 includes a conveyor 42 mounted on rollers 43 connected to the frame 31. Drive motors 44 and 45 are mounted on the frame 31. The drive motor 44 drives an initial delivery conveyor. The conveyor 42 is driven by drive motor 45. The outer surface of the conveyor 42 includes perpendicularly extending timing lugs 46 which engage a plurality of rectangular carton bases 47, indicated in dash lines in FIG. 1.

Figure 3:
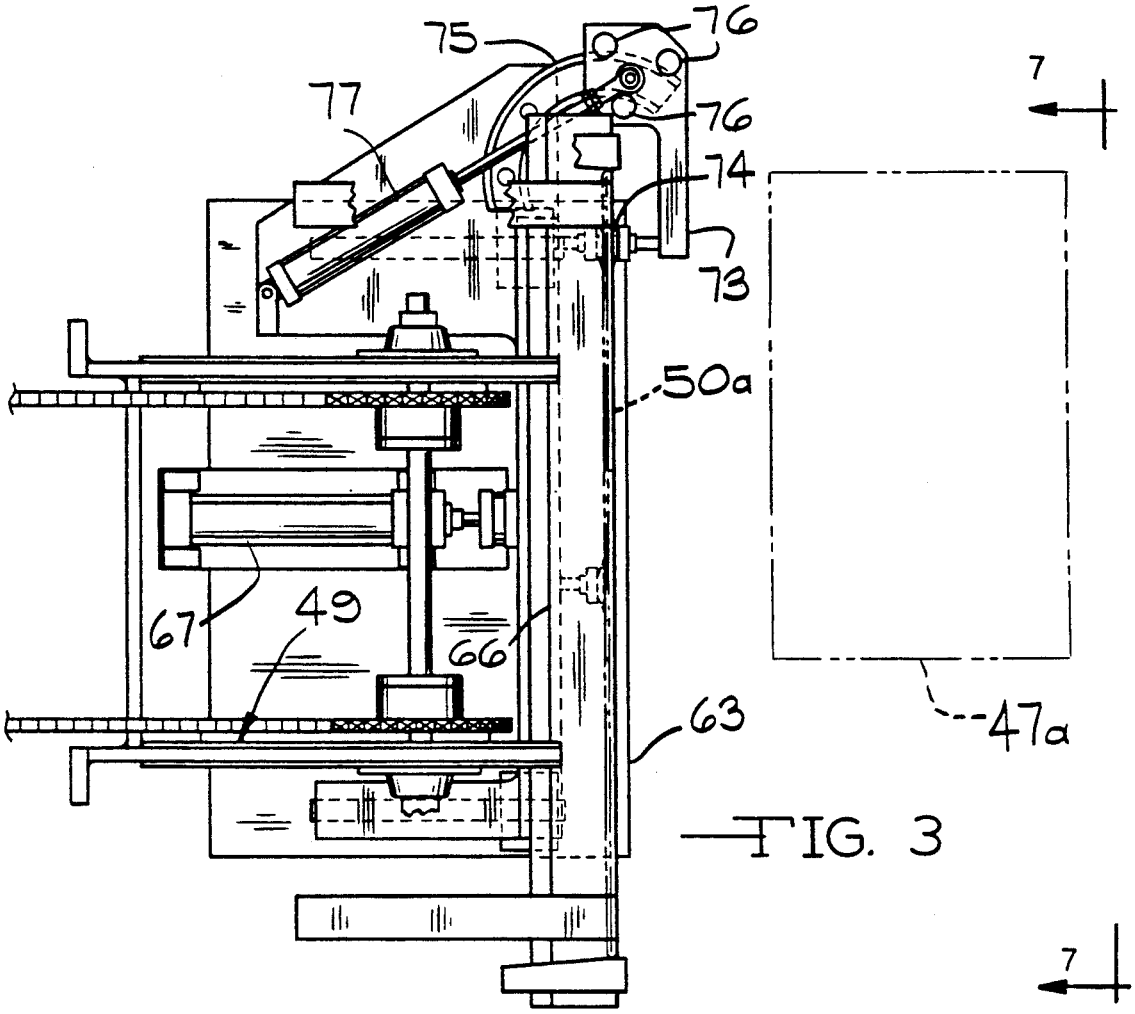
FIG. 3 is a fragmentary top plan view at the entrance end of the carton assembly machine showing the means for opening a folded cover.
Figure 4:
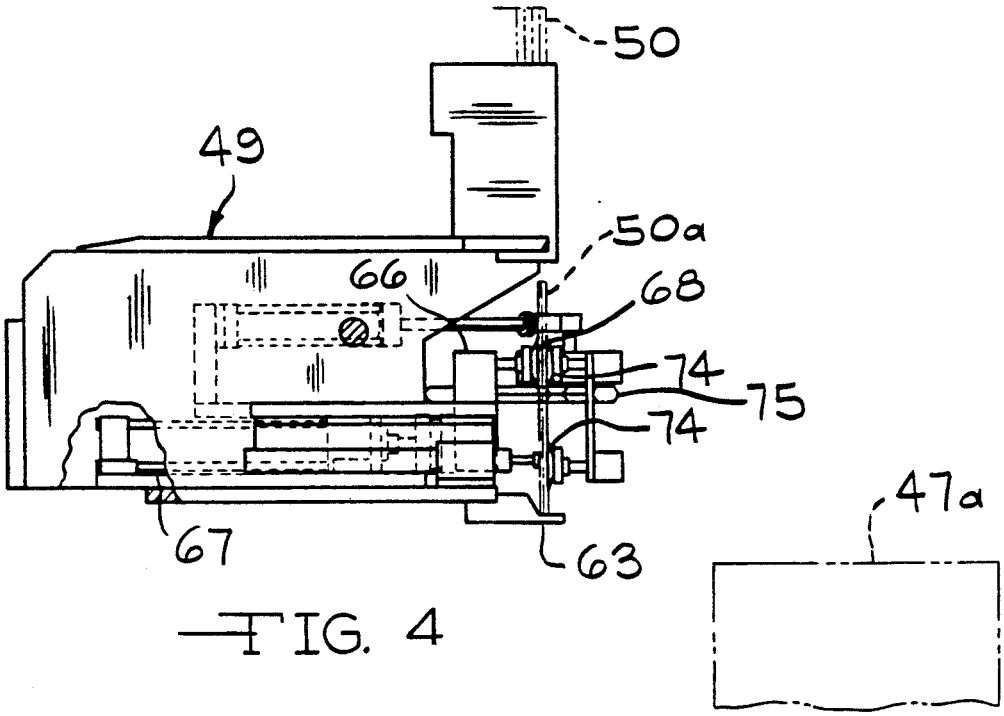
FIG. 4 is a side view of the apparatus shown in FIG. 3.
Figure 7:
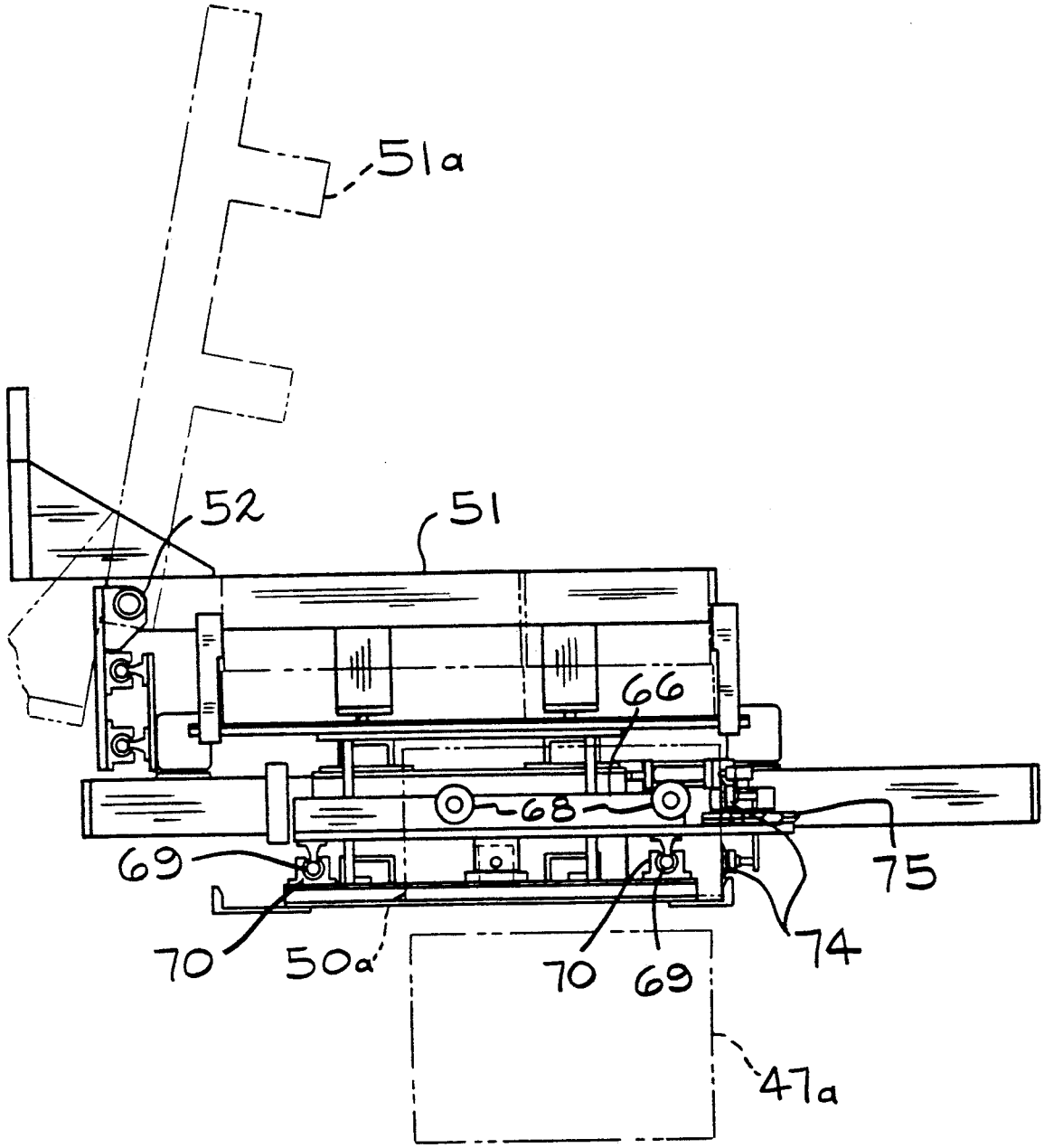
FIG. 7 is an end view taken generally along the line 7—7 of FIG. 1 and showing the discharge end of the upper conveyor.

Referring to FIG. 3, the second chain conveyor means 49 delivers a plurality of folded covers or lids 50 toward the unfolding station 37. Referring to FIG. 7, a pusher arm 51 is pivotally mounted on a rod 52 and is movable between the solid line down position shown at 51 and the upper dash line position 51*a*. The pusher arm 51 engages the rear end of a plurality of the folded covers 50. The chain conveyor means 49 is engaged by the pusher arm 51. The arm 51 and the conveyor means 49 urge the folded lids 50 toward the unfolding station 37. A cylinder 53 is operatively connected to the chain conveyor means 49 to urge the arm 51 toward the unfolding station 37 as the covers 50 are moved along the second conveyor means 49.

Figure 2:
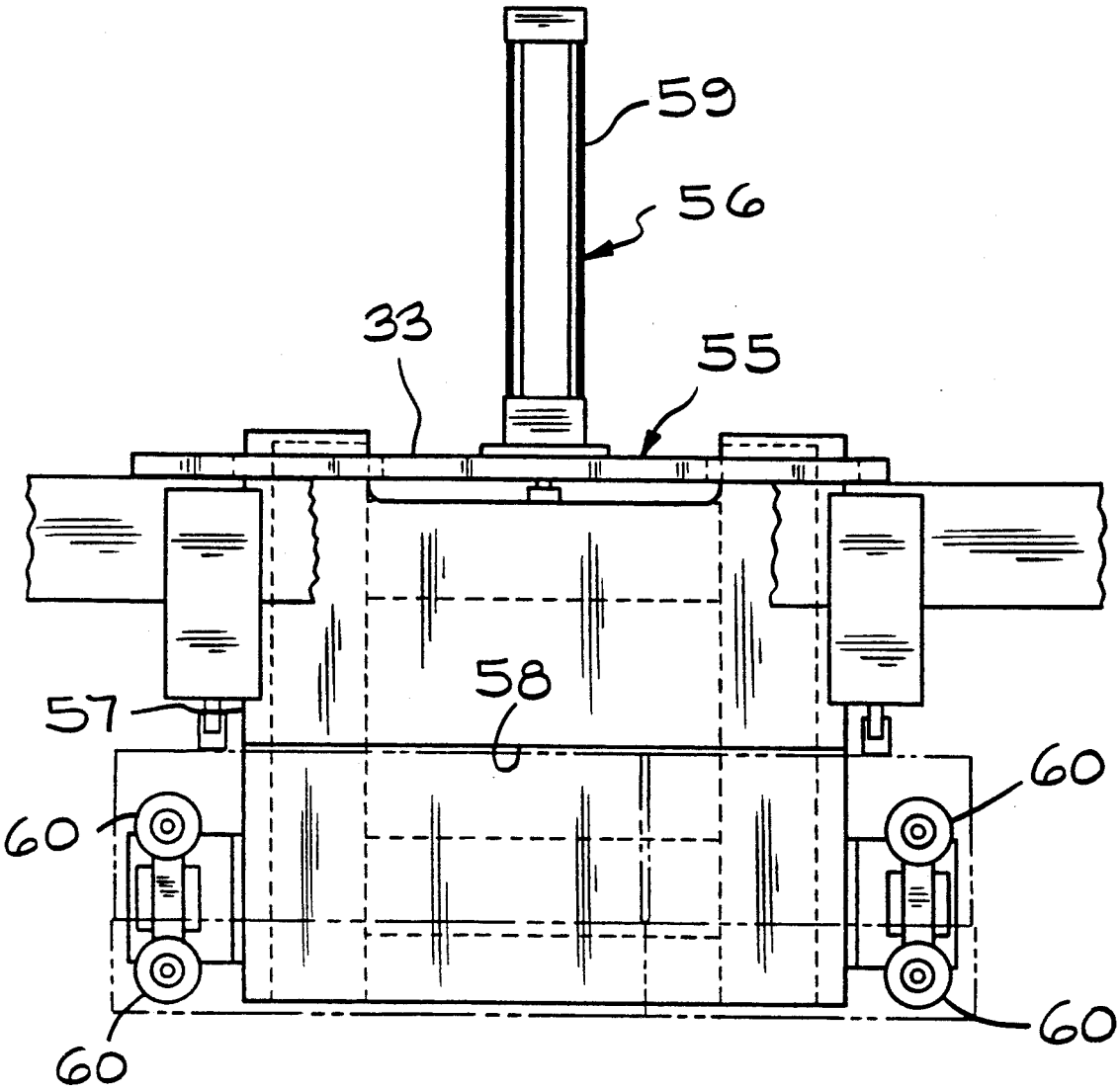
FIG. 2 is a fragmentary elevational view taken along the line 2—2 of FIG. 1 and showing in dashed lines a cover and base.
Figure 2:
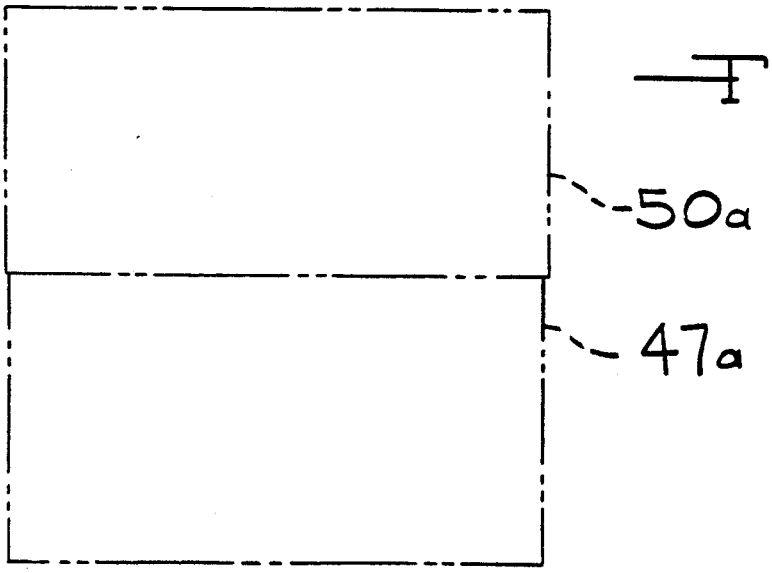

Referring to FIG. 2, a first cover means 55 is shown. The first cover means 55 includes a plunger assembly 56 having a plunger plate 57. The plunger plate 57 has a lower edge 58 which engages the forwardmost one of the folded covers 50 on the second conveyor means 49. The plunger plate 57 is supported by the platform 33. A cylinder 59, preferably an air cylinder, is operatively connected to the plunger plate 57 for moving the lower edge 58 of the plunger plate 57 downwardly.

Figure 5:
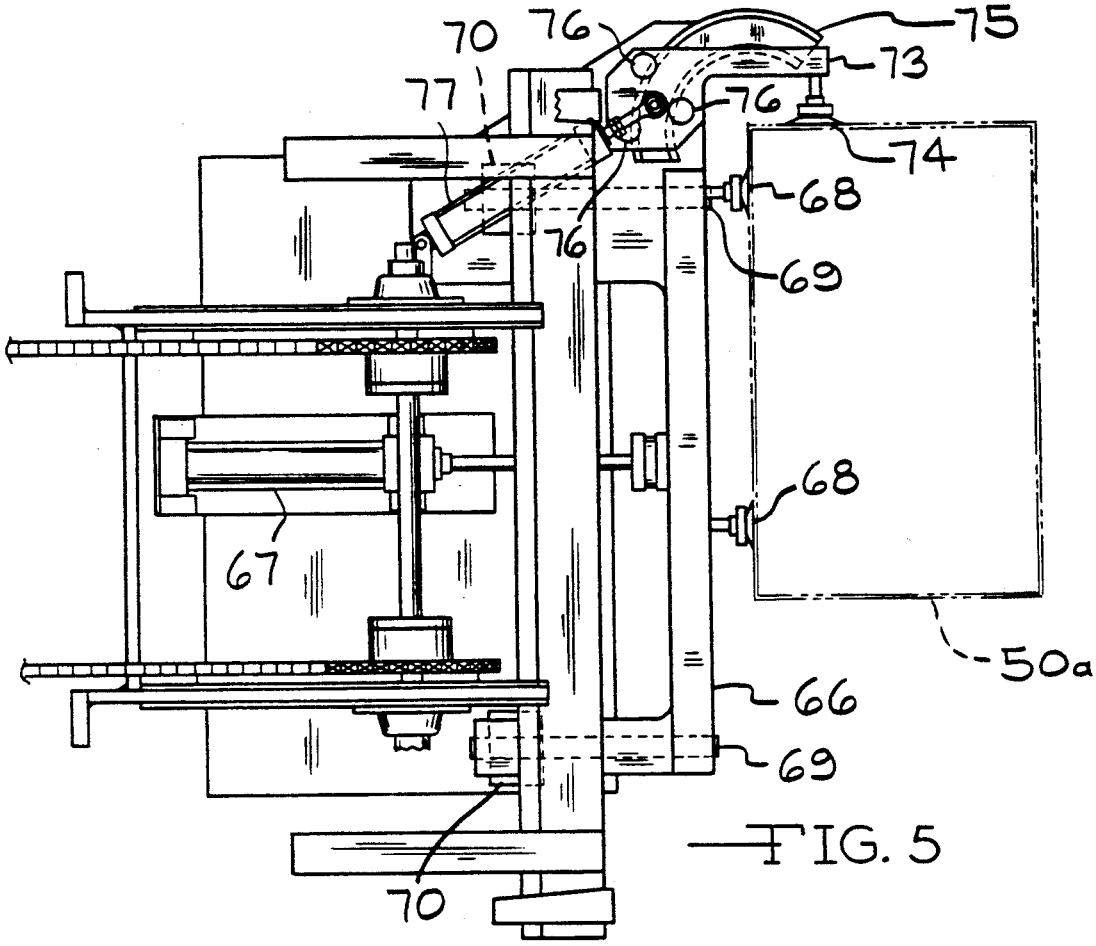
FIG. 5 is a view similar to FIG. 3 showing the cover in its open position.
Figure 6:
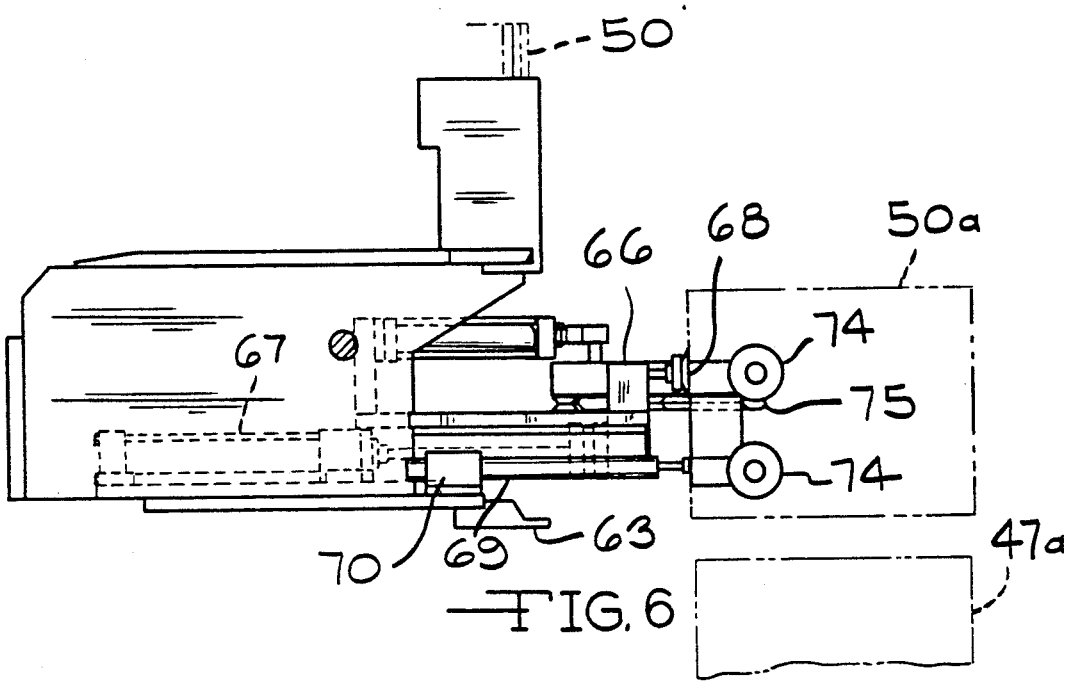
FIG. 6 is a view similar to FIG. 4 showing the opened cover moved over a carton base.

The first cover means 55 also includes a first set of suction cups 60. The first set of suction cups 60 are operatively connected to a cylinder 62 which moves the suction cups 60 a short distant in a horizontal direction. The suction cups 60 grasp the first folded cover 50 on the second conveyor means 49 and moves that specific cover 50 a short horizontal distance until it is aligned in the unfolding station 37 directly beneath the lower edge 58 of the plunger plate 57. Upon activation of the cylinder 59, the plunger plate 57 moves vertically downwardly. The lower edge 58 engages the first cover 50*a* and moves it downwardly against a stop 63, indicated in dash lines in FIG. 1. A movable lower frame 66 is driven horizontally by a cylinder 67 (see FIG. 3). A lower set of suction cups 68 engage the lowered folded cover 50*a*. As best shown in FIG. 7, the movable lower frame 66 has tracks 69 mounted on its lower surface which ride in complementary guide rails 70. Referring to FIGS. 3 and 5, the movable frame 66 mounts an arm 73 which is movable between a closed position, shown in FIG. 3 and an open position, shown in FIG. 5. A set of suction cups 74 are mounted at the distal end of the arm 73. A curved guide track 75 is mounted on the frame 66. The arm 73 includes a plurality of follower rollers 76 positioned on opposite sides of the curved guide track 75. A radial slide plate (not shown) or other types of guide means can be utilized instead of the rollers 76. A cylinder 77 mounted on the movable lower frame 66 is connected to the arm 73. When the cylinder 77 is extended as shown in FIG. 3, the arm 73 is in its closed position and when the cylinder 77 is retracted, as shown in FIG. 5, the arm 73 is in the open position. Moving the arm 73 from the closed FIG. 3 position to the open FIG. 5 position, unfolds the cover 50*a* to its open FIG. 5 position. At the same time, the cylinder 67 is extended and the opened cover 50*a* is moved to the assembly station 38.

Figure 8:
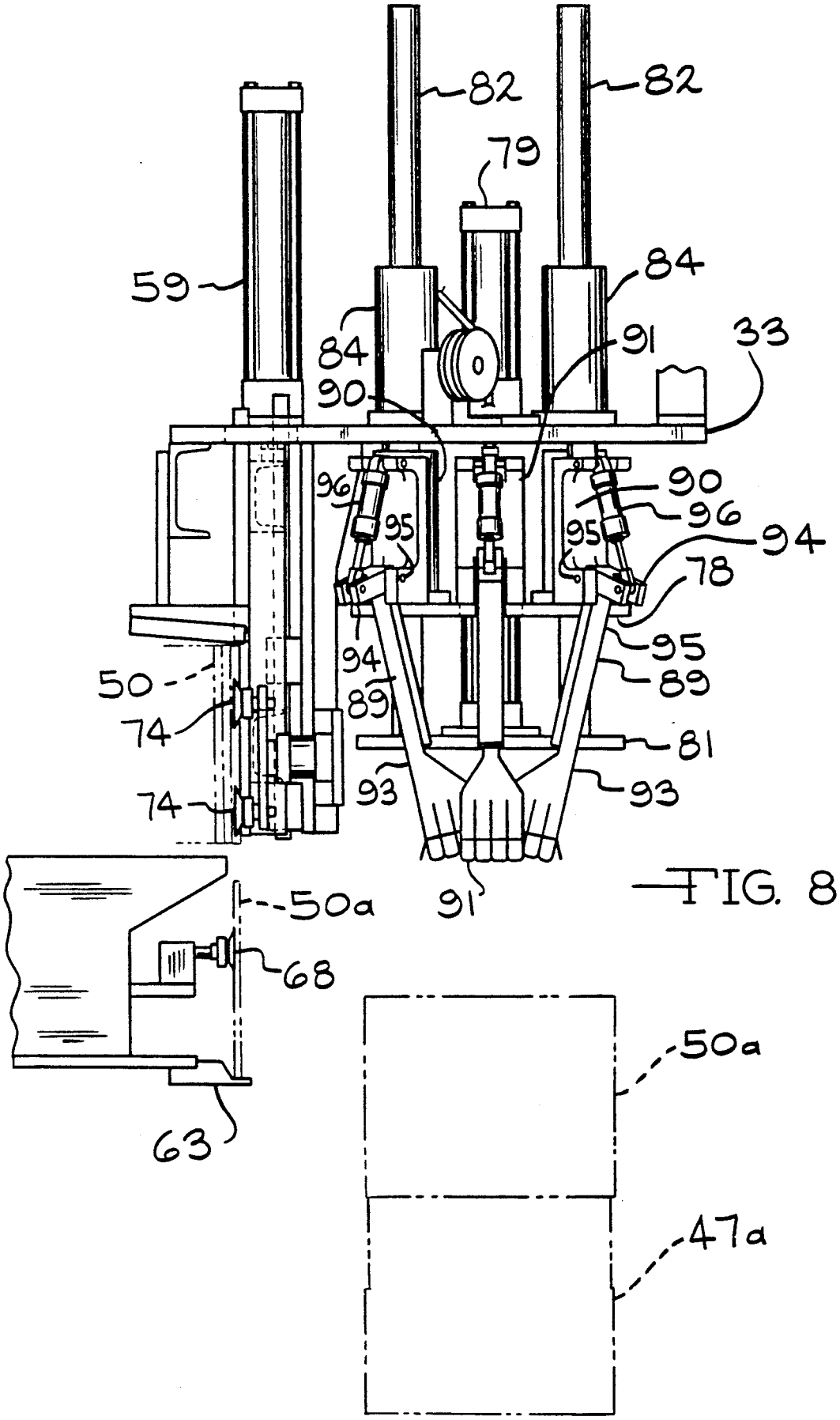
FIG. 8 is a fragmentary elevational view showing portions of the first and second cover means.
Figure 10:
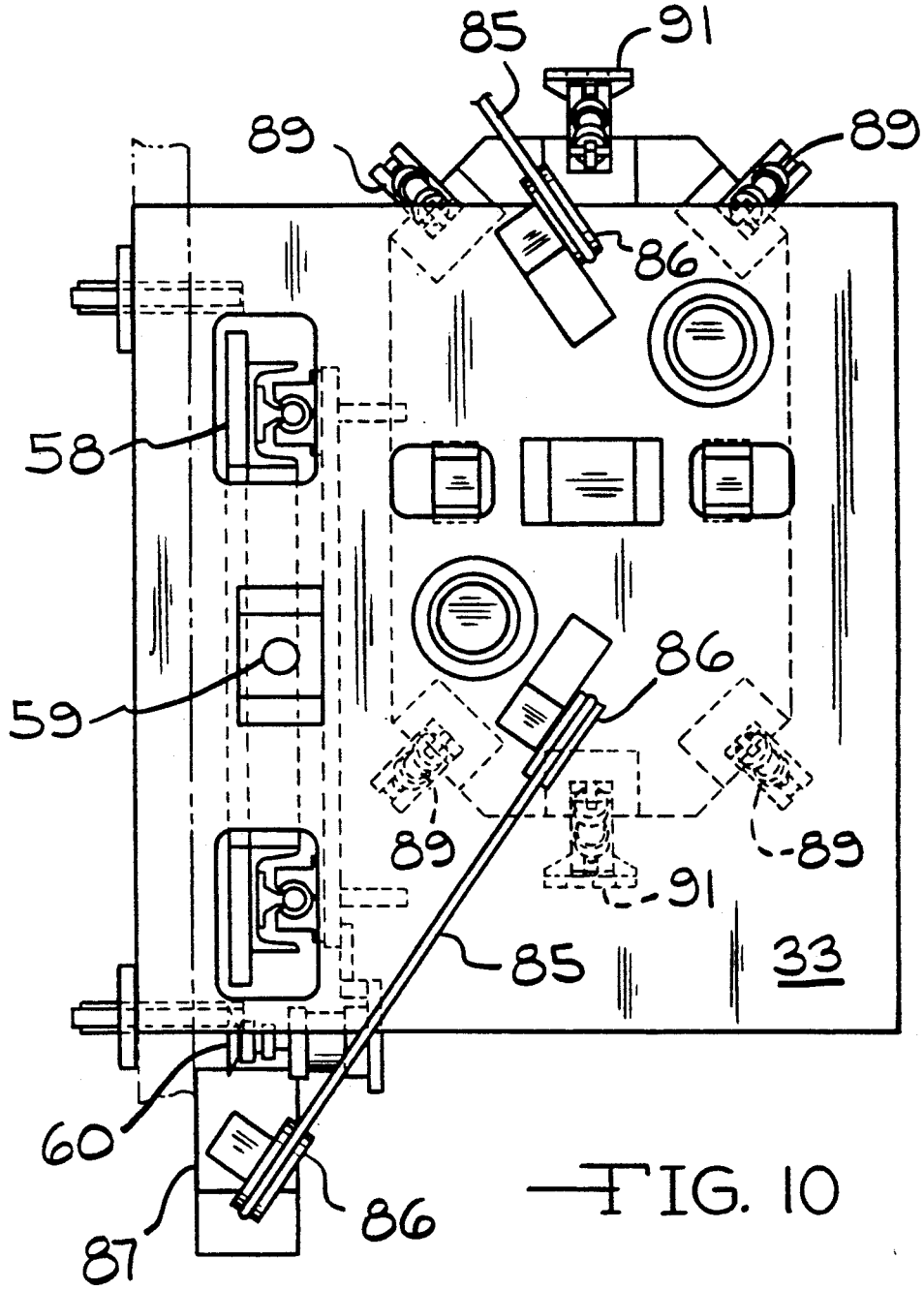
FIG. 10 is a fragmentary top view of the apparatus shown in FIGS. 8 and 9.

When at the assembly station 38, the unfolded cover 50*a* is positioned over a respective rectangular carton base 47*a* which has been delivered by the first conveyor means 41. Referring to FIGS. 8, 9 and 10, an intermediate support plate 78 is mounted beneath the platform 33. A cylinder 79 is mounted on the platform 33. A tandem cylinder 80 is mounted by and beneath the cylinder 79 and supports a subplatform 81. Guideposts 82 are journaled in end bearings 83 and 84 mounted on the support plate 78 and the platform 33, respectively. The guideposts 82 guide the vertical movement of the support plate 78 and the subplatform 81 when the cylinders 79 and 80 are extended and retracted.

Counterbalance cables 85 are attached to the support plate 78 and extend upwardly through holes provided in the platform 33. The cables extend over cable pulleys 86. The opposite ends of the counterbalance cables 85 are connected to counterbalance assemblies 87 (see FIG. 10). The counterbalance assemblies 87 acting through the counterbalance cables 85 aid the support plate 78 and subplatform 81 in a smooth vertical movement during operation.

A plurality of hand assemblies 89 are pivotally mounted by generally C-shaped members 90 which are fixed to the support plate 78. The plurality of hand assemblies 89, in the present embodiment, includes a pair of opposed flap assemblies 91. Each of the hand assemblies 89 includes a longitudinally extending lower portion 93 and an upper portion 94 which is affixed to and extends in a direction generally perpendicular to the lower portion 93. Pivot pins 95 pivotally connect a lower leg of a "C"-shaped member 90 to a hand assembly 89 at the intersection of the lower portion 93 and upper portion 94. Hand cylinders 96 are pivotally mounted to, and extend between, the distal ends of the upper portions 94 of the hand assemblies 89 and the upper legs of the "C"-shaped members 90. Extension and retraction of the hand cylinders 96 pivot the lower portions 94 of the hand assemblies 89 radially inwardly and outwardly. Accordingly, when the hand assemblies 89 are moved vertically downwardly to a first down position into the top of the cover 50*a* retraction of the hand cylinders 96 (exclusive of the flap assemblies 91) urge the hand assemblies 89 outwardly into grasping engagement with the cover 50*a*.

Figure 16:
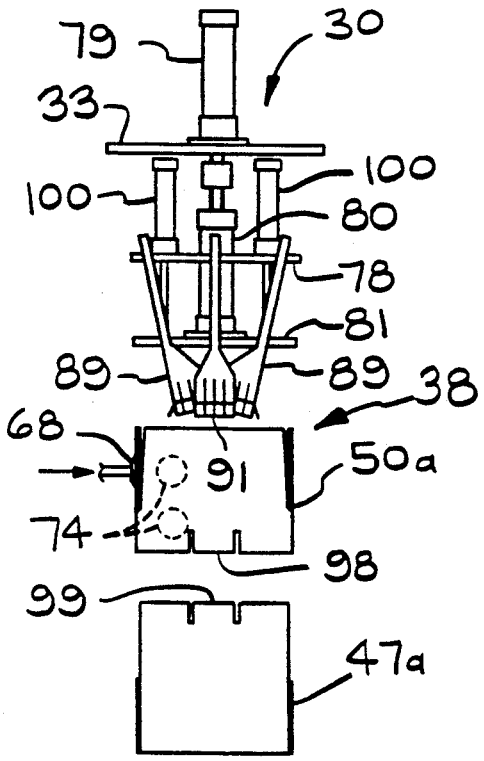
Figure 17:
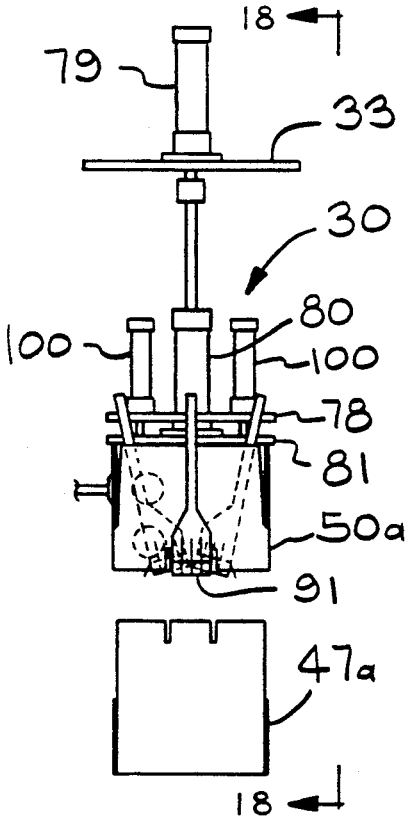
Figure 18:
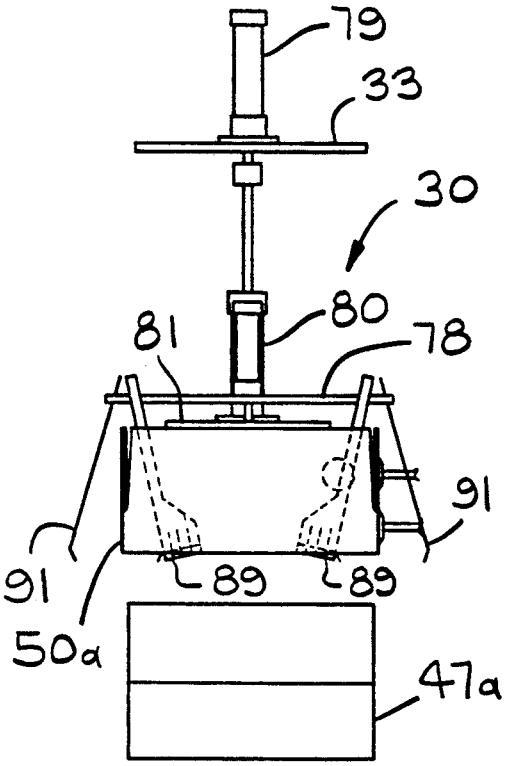

Similarly, after the flap assemblies 91 have moved downwardly along the exterior of the cover 50*a*, they engage the side of a flap 98 on the cover 50*a*, see FIGS. 16 and 17. Extension of the hand cylinders 96 connected to the flap assemblies 91 move the flaps 98 a short distance inwardly so that they may mate with flaps 99 (see FIG. 16) on the lower rectangular carton base 47*a*. Preferably, the distal ends of the respective hand assemblies 89 are shaped to perform their intended functions. For example, the flap assemblies 91 have a different distal configuration than do the remaining hand assemblies 89.

Referring to FIGS. 15–24, a diagrammatic sequential presentation of the operation of the carton assembly machine 30 is shown.

Figure 15:
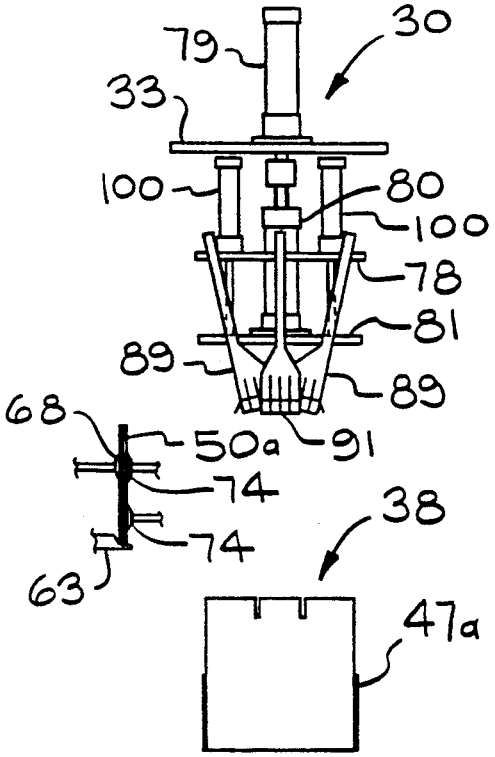
FIGS. 15-26 are diagrammatic views showing a cover or lid being positioned in an overlying relationship with a carton base by the carton assembly machine and showing the tape applied.

Referring to FIGS. 9 and 15, a pair of cylinders 100 are mounted on the support plate 78 and have rods which are connected to the subplatform 81. While the tandem cylinders 79 and 80 move the entire second cover means vertically upwardly and downwardly, the pair of stripper cylinders 100 move the subplatform 81 vertically upwardly and downwardly relative to the support plate 78. As will be explained below, the subplatform 81 is positioned adjacent the upper end of the carton 50*a* during assembly with the base 47*a*. The hand assemblies 89 are moved vertically upwardly by extending the stripper cylinders 100. At the same time, the subplatform 81 remains in contact with the upper end of the cover 50*a* to prevent upward movement after its assembly on the carton base 47*a*.

Referring to FIG. 15, the cover 50*a* is shown in its folded condition. The mating carton base 47*a* is shown at the assembly station 38 and the hand assemblies 89 of the second cover means are shown in their elevated position.

Referring to FIG. 16, the carton 50*a* has been opened and the cylinder 67 extended to move the open carton 50*a* to the assembly station 38 where it is vertically positioned above the carton base 47*a*.

At this time, the cylinder 79 is extended moving the subplatform 81 downwardly adjacent the upper end of the unfolded carton 50*a* and positioning all of the hand assemblies 89 in the first down position within the unfolded cover 50*a* with the exception of the two flap assemblies 91 which are positioned along the exterior of the cover 50*a*. At the end of the extension of the cylinder 79, the carton assembly 30 is in the position shown in FIGS. 17 and 18.

Figure 19:
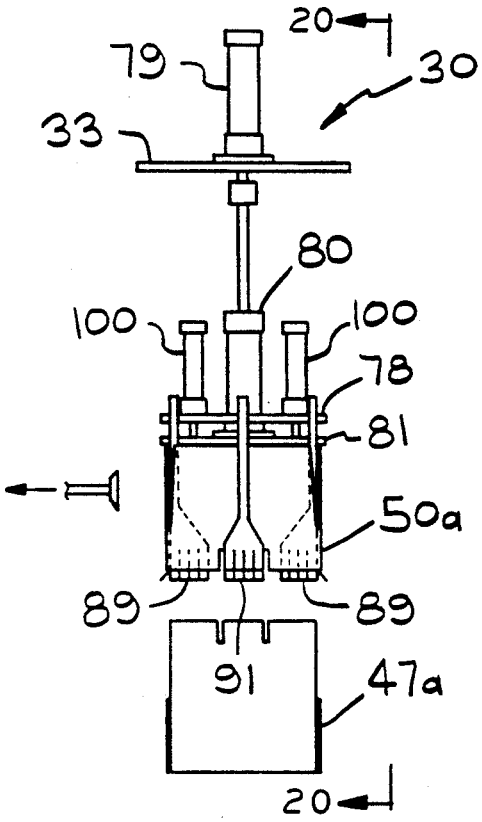
Figure 20:
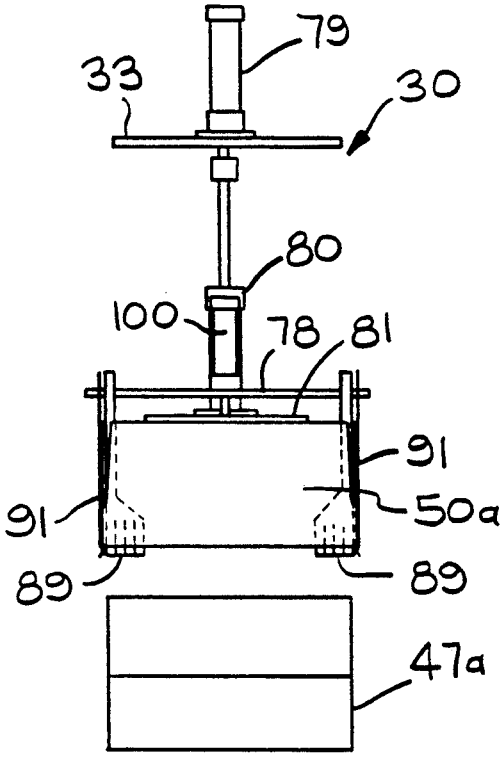
Figure 21:
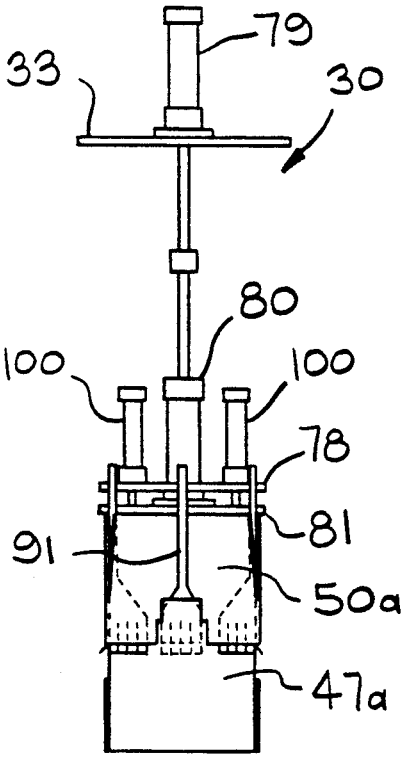
Figure 22:
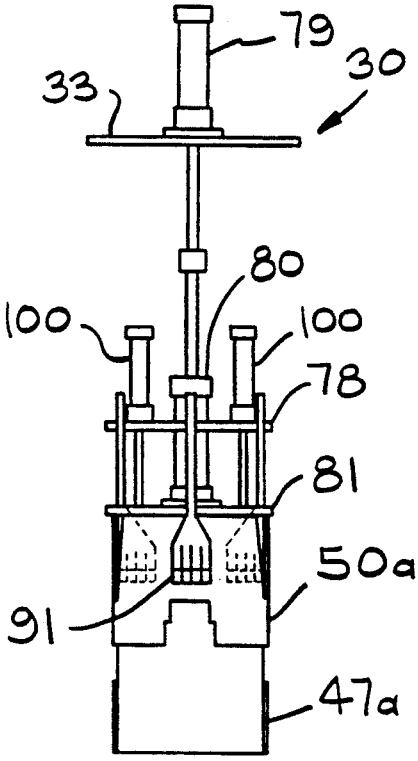

Referring to FIGS. 19 and 20, the hand cylinders 96 (see FIG. 9) are energized moving the flap assemblies 91 adjacent the exterior side of the cover 50*a* and the remaining hand assemblies 89 into a grasping condition adjacent the interior of the cover 50*a*. As shown in FIG. 21, the tandem cylinder 80 is then extended moving the cover 50*a* to a second down position into an engaged and overlying relationship with the carton base 47*a*. Next, as shown in FIG. 22, the cylinders 100 are extended leaving the subplatform 81 in a holding position against the assembled cover 50*a* while moving the support plate 78 and the hand assemblies 89 upwardly. Prior to the upward movement, the hand cylinders 96 are energized moving them away from the cover 50*a*.

Figure 23:
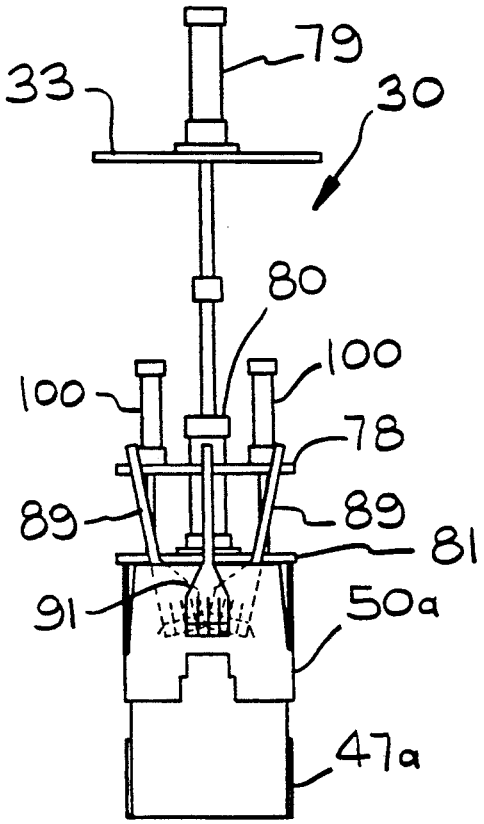
Figure 24:
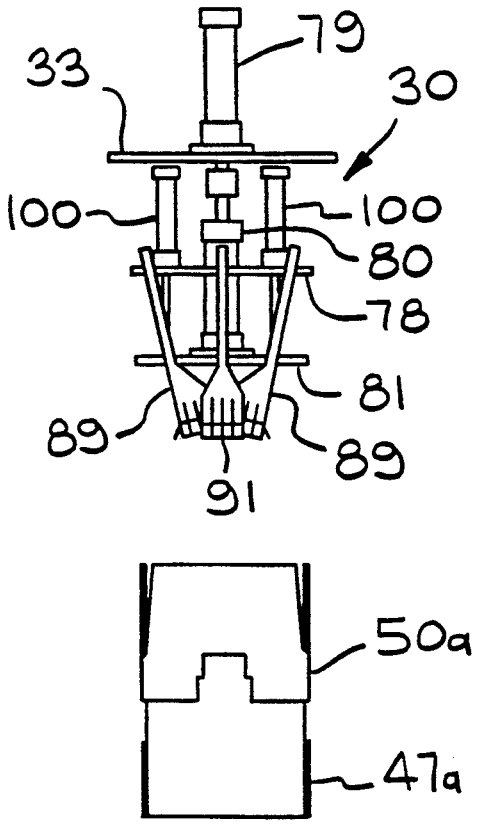

The relaxed positions of the hand assemblies 89 are shown in FIG. 23. The tandem cylinders 79 and 80 are then energized to move the hand assemblies 89 upwardly away from the assembled carton as shown in FIG. 24. After the assembled cover 50*a* and base 47*a* are in the FIG. 24 position, the first conveyor means 41 delivers the assembled unit to the taping station 39. The last operation takes place at the taping station 39 where a strip of tape 101 is applied to the overlying carton members 47*a* and 50*a* to complete the assembly.

Referring to FIGS. 11–14, the tape means includes a pair of taping assemblies 102 mounted on each side of the assembled carton including the cover 50*a* and base 47*a*. Tape supply rolls 103 have a tape strip 104 extending from each of the rolls 103. The rolls 103 are mounted by roll spindle assemblies 105 attached to the tape platform 34 by plates 106. A vertically movable hold down plate 107 is mounted by a hold down cylinder 108. Guideposts 109 extend upwardly from the hold down plate 107 through the tape platform 34 where they are journaled in cylindrical bearings 110. During the taping operation, the hold down cylinder 108 is extended moving the hold down plate 107 and its depending legs 111 downwardly into an engaging and holding position to ensure that the cover 50*a* remains in a correct overlying position with the base 47*a*.

Figure 12:
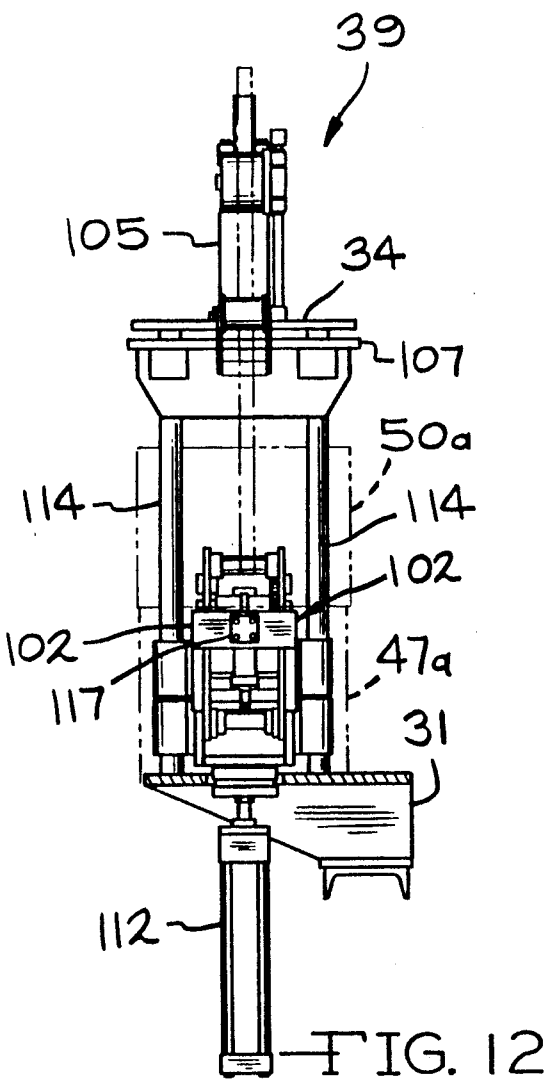
FIG. 12 is a side view of the apparatus shown in FIG. 11.
Figure 11:
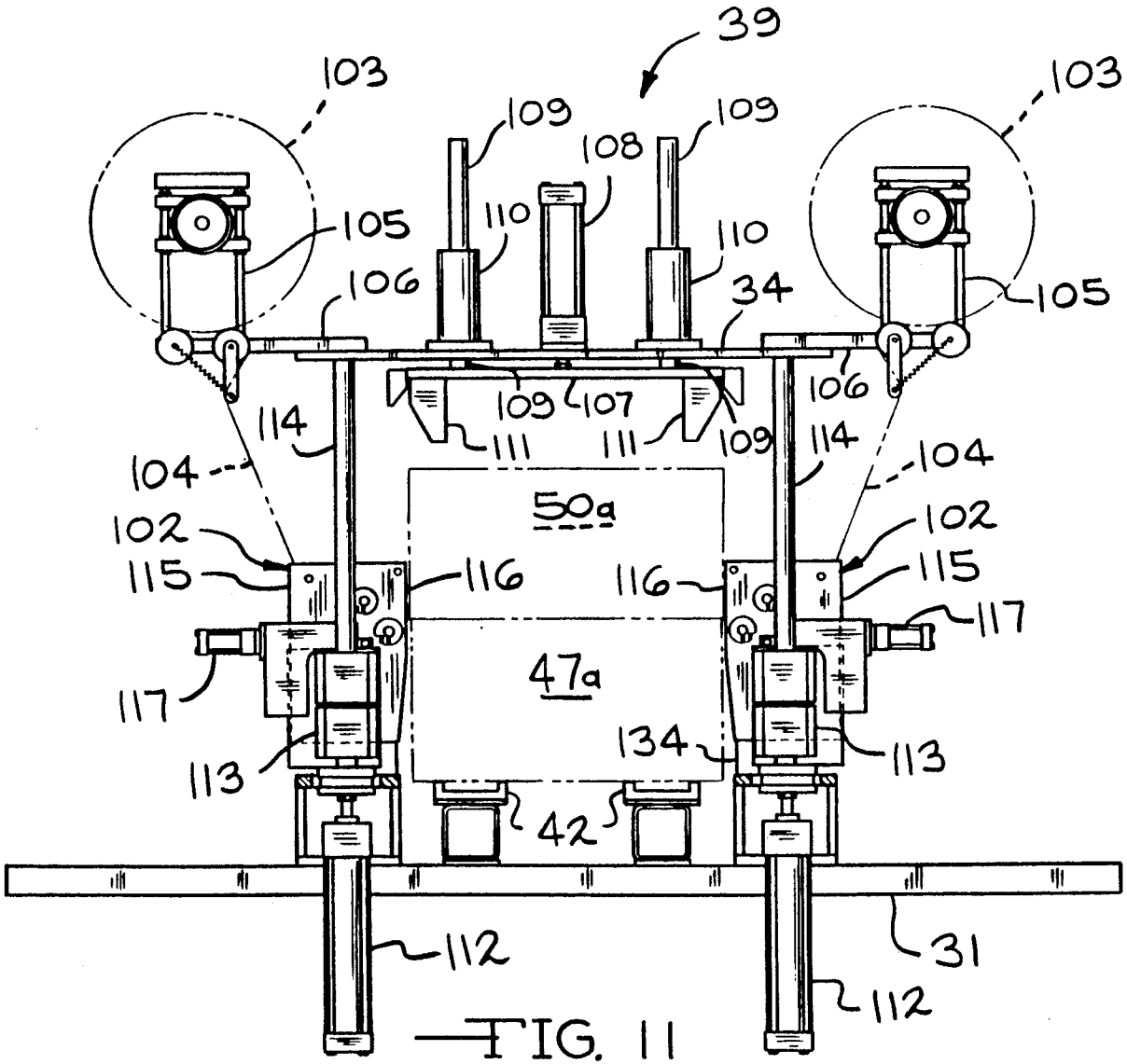
FIG. 11 is a fragmentary elevation view of the tape assembly portion of the carton assembly machine.
Figure 25:
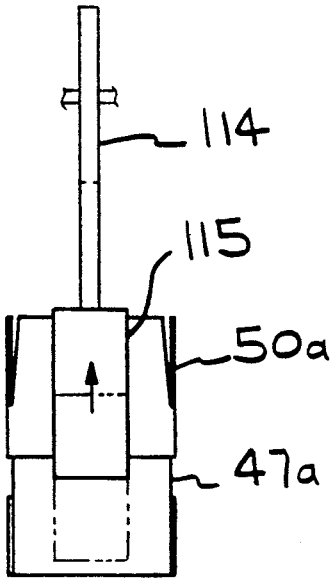

Referring to FIGS. 11 and 12, bearing blocks 113 are slideably mounted on guide rods 114 and are attached to tape heads 115 of the taping assemblies 102. The guide rods 114 guide the vertical movements of the tape heads 115 as they are driven upwardly by drive cylinders 112. The tape heads 115 are pivotally mounted at their lower end. Upper surfaces 116 of the tape heads 115 may be moved in a generally horizontal path by the action of placement cylinders 117. The placement cylinders 117 move the upper surfaces 116 of the tape heads 115 into a tape applying position after the cover 50*a* and base 47*a* are in the tape applying position (see FIG. 25).

Figure 14:
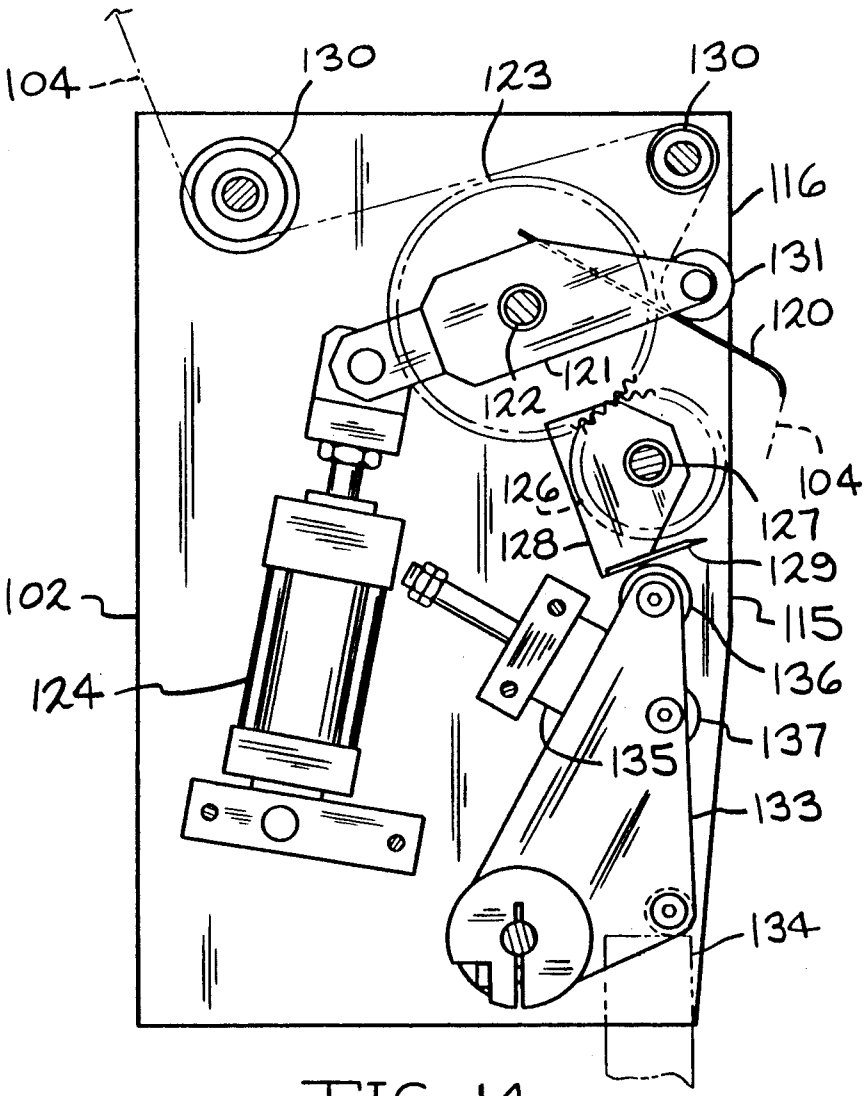
FIG. 14 is a fragmentary elevational view with the side panel removed of the apparatus shown in FIG. 13.
Figure 13:
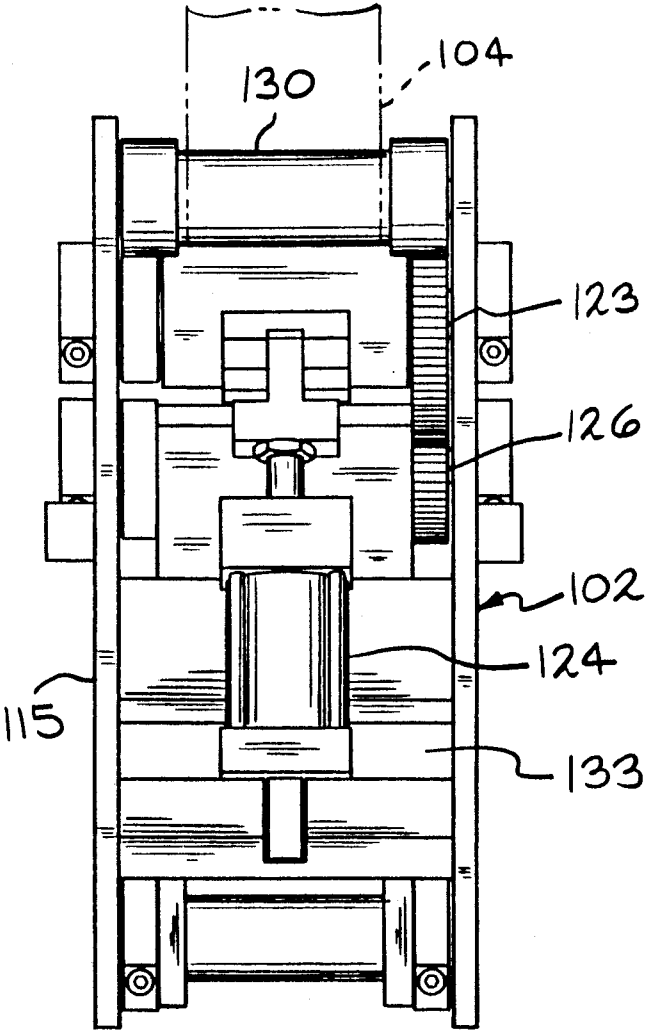
FIG. 13 is an enlarged end view of a portion of the tape assembly shown in FIG. 11.
Figure 26:
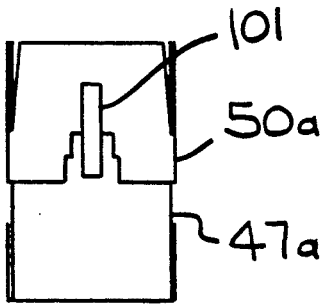

Referring to FIGS. 13 and 14, a pivotally mounted tape arm 120 is attached by a link 121 to a pivot shaft 122. A larger sector gear 123 is also mounted on the shaft 122. The other end of the link 121 is connected to a cylinder 124. The sector gear 123 mates with a smaller gear 126 mounted on a shaft 127. The shaft 127 also mounts a plate 128 having a knife 129 on one side. The tape strip 104 as it feeds from the tape roll 103 is fed around rollers 130 in the tape head 115. It is also fed behind a roller 131 carried by the link 121 and across the tape arm 120. When the cylinder 124 is in its retracted position as shown in FIG. 14, the tape arm 120 is moved outwardly into an engaging position with the assembled cover 50*a* and base 47*a*. The cylinders 112 are extended moving the entire tape head upwardly including the tape arm 120. This applies the tape strip 104 to the assembled cover 50*a* and base 47*a*. Upon the completion of the vertical movement of the cylinders 112 and the tape arm 120, the cylinder 124 is extended. This rotates the tape arm 120 downwardly out of an engaging relationship. At the same time, the sector gear 123 is rotated together with its mating gear 126 to move the knife 129 against the tape 104 to complete the cutting of the short tape strip 101 (see FIG. 26).

Referring to FIG. 14, a spring-loaded roller assembly 133 is positioned below the knife 129. The roller assembly 133 is moved vertically upwardly by the cylinders 112. As the roller assembly 133 moves away from a stop 134 the spring assembly 135 urges pressure rollers 136 and 137 to the right, as shown in FIG. 14, against the applied tape to ensure the tape's proper adherence to the assembled carton.

After the taping is completed, the conveyor 42 moves the assembled and taped carton to a discharge conveyor 138 (see FIG. 1) which removes the assembled and taped carton from the carton assembly machine 30. The discharge conveyor 138 is driven by the drive motor 45.

Preferably, the cylinders used in the carton assembly machine 30 are air cylinders, however, other types of cylinders can be used including hydraulic cylinders.

Numerous modifications may be made to the preferred embodiments disclosed above without departing from the invention or from the following claims.

We claim:

1. An assembly machine for a carton having a rectangular base and a cover, said machine including a frame, a first conveyor means for transporting a plurality of rectangular bases, a second conveyor means for transporting a plurality of folded covers, a first cover means for opening a cover and positioning said cover vertically adjacent one of said rectangular bases, a second cover means for grasping said cover and moving said cover downwardly into an overlying relationship with said rectangular base, said second cover means including a plurality of hand assemblies being vertically movable to a first down position within an open cover, selected ones of said plurality of hand assemblies being energized to move said selected ones into an engaging relationship with said open cover, and means for moving said selected ones vertically downwardly to said first position and to a second down position wherein said open cover overlies said prepositioned rectangular base and a taping means for applying tape to connect said cover to said rectangular base.

2. An assembly machine, according to claim 1, including pusher means operatively connected to said second conveyor means for advancing said covers toward said first cover station.

3. An assembly machine, according to claim 2, wherein said pusher means includes a pusher arm pivotally mounted adjacent said second conveyor means, said pusher arm being pivoted from an inactive position to an operating position, wherein said pusher arm engages such folded covers.

4. An assembly machine, according to claim 1, wherein said first cover means includes a plunger assembly, including a plunger plate having a lower edge for engaging a folded cover, and a plunger cylinder operatively connected to said plunger plate for moving said folded cover downwardly to a lower position.

5. An assembly machine, according to claim 4, wherein said first cover means includes a first set of cover suction cups for initially grasping such folded cover and cylinder means operatively connected to said first set of cover suction cups for moving said folded cover horizontally a short distance into alignment with said plunger plate.

6. An assembly machine, according to claim 4, including a lower frame, movable from a first position below said plunger assembly and a second position adjacent said second cover means including a cylinder operatively connected to said movable lower frame and a second set of suction cups mounted on said lower frame for holding said folded cover after delivery by said plunger plate.

7. An assembly machine, according to claim 6, including an opening assembly mounted on said movable frame, said opening assembly including an arm movable between a closed position and an open position, a third set of suction cups mounted on said arm, said third set of suction cups engaging said folded cover on a side opposite said second set of suction cups when in said closed position, cylinder means operatively attached to said arm, and guide means for guiding the movement of said arm wherein said folded cover is opened when said arm is moved from the closed position to said open position.

8. An assembly machine, according to claim 7, wherein said guide means includes a curved guide track, said arm including follower rollers mounted adjacent said curved guide track.

9. An assembly machine, according to claim 1, wherein said plurality of hand assemblies includes a pair of opposed flap assemblies for engaging a flap portion of said open cover.

10. An assembly machine, according to claim 1, including a plurality of hand cylinders operatively connected to said hand assemblies for moving said hand assemblies into such engaging relationship with said open cover.

11. An assembly machine, according to claim 1, including a platform operatively mounted on said frame, said means for moving comprising a first drive cylinder mounted adjacent said platform, a second drive cylinder connected in tandem to said first drive cylinder, said first and second drive cylinders being operatively connected to said plurality of hand assemblies for vertically moving said plurality of hand assemblies to such first and second down positions.

12. An assembly machine, according to claim 1, including a vertically movable subframe and an intermediate support plate, said plurality of hand assemblies being operatively connected to said support plate, and guide means for guiding the vertical movement of said subframe and said intermediate support plate.

13. An assembly machine, according to claim 12, including a counterbalance assembly operatively connected to said vertically movable intermediate support plate.

14. An assembly machine, according to claim 12, including stripper cylinders operatively connected to said subframe, whereby said subframe can be vertically moved relative to said intermediate support plate.

15. An assembly machine, according to claim 1, wherein said taping means comprises opposed tape assemblies for taping each side of said carton having a cover positioned on a rectangular base, each of said tape assemblies including a tape supply roll and a pivotally mounted tape arm adjacent one side of said carton, means for pivoting said arm to engage a portion of the tape to the carton, means for moving said tape arm vertically to apply a length of tape to one side of said carton and means for cutting said tape.

16. An assembly machine, according to claim 15, including spring-loaded roller means adjacent such carton for engaging said length of tape after it is applied to such carton.

17. An assembly machine, according to claim 15, including first tape cylinder means for moving said tape arm horizontally toward and away from said carton.

18. An assembly machine, according to claim 17, including second tape cylinder means for pivoting said tape arm and wherein said cutting means includes a pivotally mounted cutter driven by said second tape cylinder.

19. An assembly machine, according to claim 18, wherein said second tape cylinder is operatively connected to a first gear for rotating said gear, a second gear mating with said first gear, said cutter being operatively connected to said second gear whereby extension and retraction of said second tape cylinder moves said cutter into and out of a tape cutting position.

20. An assembly machine, according to claim 15, wherein said moving means comprises a third tape cylinder for moving said tape arm vertically.

21. An assembly machine, according to claim 15, including a third conveyor means for receiving assembled cartons from said taping means and removing such assembled cartons from said assembly machine.

* * * * *